US005241750A

United States Patent [19]

Chomiak

[11] Patent Number: 5,241,750

[45] Date of Patent: Sep. 7, 1993

[54] UTILITY RAZOR SAFETY KNIFE

[76] Inventor: Bryant D. Chomiak, 4185 Mardon Ave., Las Vegas, Nev. 89118

[21] Appl. No.: 875,309

[22] Filed: Apr. 30, 1992

[51] Int. Cl.[5] ..... B26B 3/08

[52] U.S. Cl. ..... 30/2; 30/286

[58] Field of Search ..... 30/2, 294, 286

[56] References Cited

U.S. PATENT DOCUMENTS

| | | | |
|---|---|---|---|
| 2,376,887 | 5/1945 | Walters | 30/286 |
| 2,686,360 | 8/1954 | Fisher | 30/2 |
| 2,730,800 | 1/1956 | Bailey | 30/2 |
| 2,743,523 | 5/1956 | Honey | 30/286 |
| 3,781,988 | 1/1974 | Jones | 30/2 |
| 4,531,286 | 7/1985 | Vito et al. | 30/2 |
| 4,675,996 | 6/1987 | DuBuque | 30/2 |

*Primary Examiner*—Douglas D. Watts
*Assistant Examiner*—Rinaldi Rada
*Attorney, Agent, or Firm*—William S. Ramsey

[57] ABSTRACT

An improved utility razor safety knife is disclosed. The knife hood is normally in the closed position where the blade is protected. The hood may be locked in the closed position by a sliding hood lock. The hood pivots into the open position, exposing the razor blade, when the knife is in use. The hood is stabilized in its movement and biased toward the closed position by a yoke with two legs which is attached to an arm on the handle. Springs on the yoke bias the hood toward the closed position. Springs of varying gauges may be used to vary the closing impulse on the hood. The legs of the yoke exert their influence through footing pieces which are received by socket-bearing footing rests attached to the sides of the hood. The footing rests stabilize the knife in an upright position when the knife is resting on a surface and also stabilize the razor blade during cutting.

4 Claims, 2 Drawing Sheets

UTILITY RAZOR SAFETY KNIFE

BACKGROUND OF THE APPLICATION

1. FIELD OF THE INVENTION

This invention relates to knives with retractable sheaths or hoods.

2. Description of Related Art

This invention provides improvements in knives with retractable hoods. This invention provides a retractable hood with improved durability, reliability, a biasing tension which is adjustable, and a hood which is transparent, stabilizes the knife against tipping, ensures a right-angle cut, and may be locked closed.

U.S. Pat. No. 2,376,887 discloses two embodiments of a package cutter having a pivoting mounted guard which covers exposed parts of the blade. The guard has two rearwardly projecting ears, one of which has an opening through which a pivot member is engaged and also has a spring which engages the pivot member and urges the guard to a blade covering position.

U.S. Pat. No. 2,730,800 discloses a safety paper box cutter having a razor blade inserted through an opening of the body where the blade is retained bearing against a body end wall. The guard member is pivoted near the end of the body and is yieldingly held in the operating position by the spring.

U.S. Pat. No. 2,743,523 discloses a carton opening knife with a razor blade which fits into a horizontally extending recess and is secured by a clip member having a run which contains the blade within the confines of the clip member when the clip is in repose.

U.S. Pat. No. 3,781,988 discloses a safety paper carton opening blade holder in which a blade is retained by fingers and a guard is mounted on pivot trunnions above the blade. The guard is biased in a closed position by a spring.

U.S. Pat. No. 4,531,286 discloses a carton cutting knife in which a razor blade is retained by detent means on the blade mounting extension and a blade guard is secured to the knife by a flexible attachment strip.

These prior art inventions do not provide a safety knife with the reliable, durable, adjustable, and efficient features of the present invention.

SUMMARY OF THE INVENTION

This invention is an improved utility razor safety knife of the type having a handle, a blade attached to the handle, and a blade guard hood pivotally attached to the handle. Such knives are used for cutting paper box cartons, opening packages, and cutting sheet materials such as roofing and floor coverings. In the present invention, the hood is biased in the closed position by a yoke having two legs and a neck. There is an arm on the handle which receives the neck of the yoke and attaches the yoke to the handle. Each yoke leg has spring mounting means which urge the hood into the closed position when the knife is not in use while allowing the hood to move to the open position during use. The hood has sockets for receiving the yoke legs and spring mounting means. The sockets extend laterally from the sides of the hood and also serve to support the knife in an upright position when not is use. The sockets also serve to stabilize the knife during cutting, ensuring a right-angle cut. The hood is transparent to allow improved vision of the cutting edge of the knife while the knife is in use.

A safety lock is provided which prevents accidental exposure of the blade when the knife is not in use.

It is an object of this invention to provide a safety knife having a retractable hood of improved reliability and dependability.

It is a further object of this invention to provide a safety knife wherein the biasing tension of the hood is adjustable.

It is a further object of this invention to provide a safety knife wherein the hood may be locked in a closed position, thereby preventing accidental exposure of the blade.

It is a further object of this invention to provide a safety knife wherein the hood is transparent.

It is a further object of this invention to provide a safety knife which is stabilized against tilting when resting on a surface.

It is a further object of this invention to provide a safety knife which is stabilized to ensure a right-angle cut.

It is a further object of this invention to provide a safety knife which is safe, effective, efficient, reliable, durable, and inexpensive to manufacture.

Further objects, features, and attributes will become apparent from the following description and appended claims.

DESCRIPTION OF THE PREFERRED EMBODIMENTS

Figure 1:
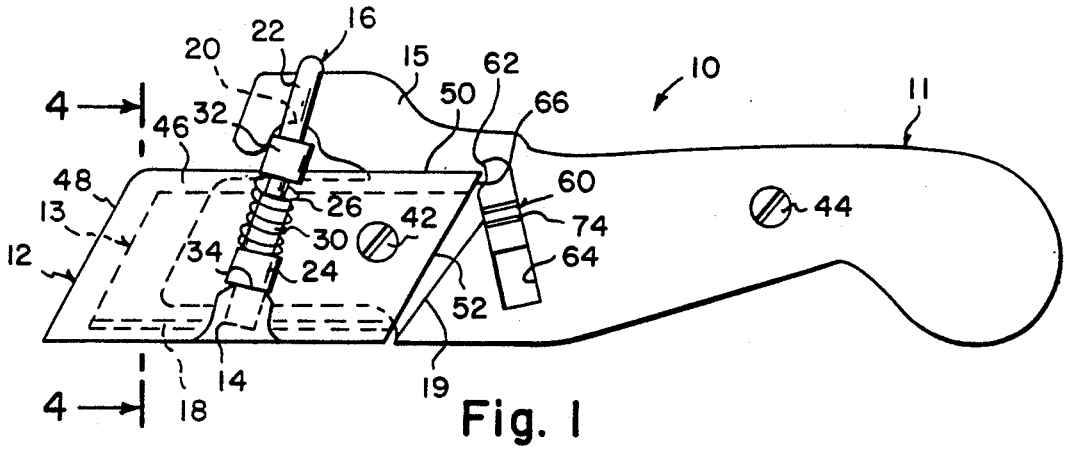
FIG. 1 is a left side view of the improved safety knife with the hood in the closed position.

FIG. 1 is a view of the left side of the improved utility razor safety knife 10. A handle 11 is shaped to fit the hand and supports the blade and other elements of the knife. In this embodiment, the handle is formed of two complementary or bivalve sides which are engaged one with the other and retained in the engaged relationship by set screws 42 and 44. Reserve razor blades may be stored in a compartment formed by the two sides of the handle. The razor blade 13 is retained by the two sides of the handle and by the set screw 42.

Figure 2:
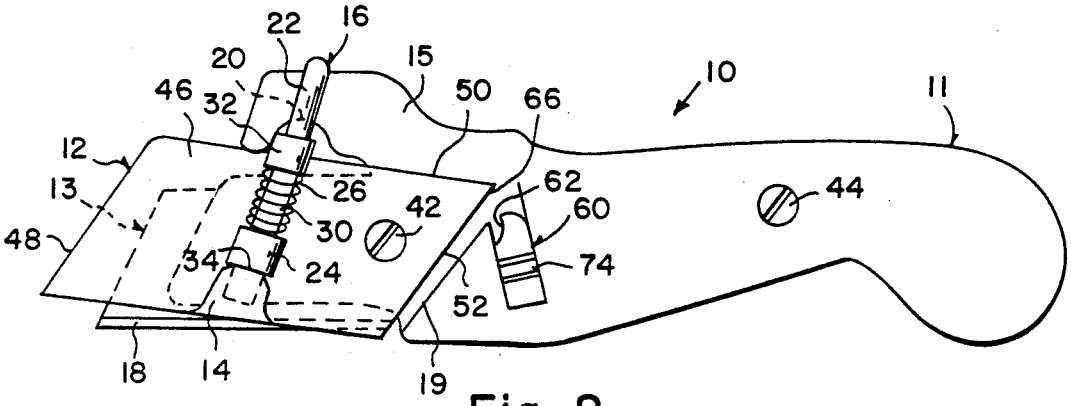
FIG. 2 is a left side view of the improved safety knife with the hood in the open position.
Figure 4:
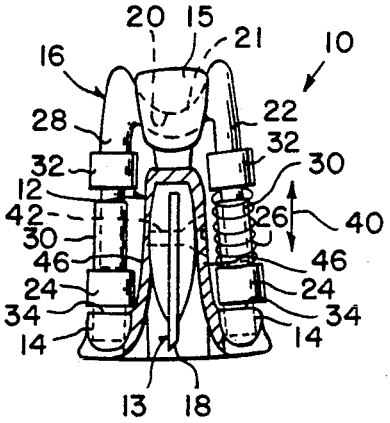
FIG. 4 is a cross-section view of the improved safety knife with the hood in the closed position taken along line 4—4 in FIG. 1.

A hood 12 envelops and protects the blade 13. The hood has a U-shaped cross section, as shown in FIG. 4. The front of the hood 48 is closed, protecting the front of the razor blade. The hood has a cut 50 in the top of the hood which accommodates the base of arm 15 of the handle. The sides of the hood 46 extend below the edge 18 of the blade when the hood is in the closed position. Thus the hood protects the entire blade when in the closed position. When the hood is in the closed position, as in FIGS. 1 and 4, the hood sides 46 extend below the blade and covers the blade, thereby protecting the user against injury by the blade. In addition, the sharp edge of the blade is protected against being dulled or nicked. When the hood is in the open position, as in FIG. 2, the edge 18 of the blade extends below the hood sides, exposing the blade for use in cutting. The hood is placed in the open position by pivoting on set screw 42. The pivoting movement of the hood is arrested by a protruding bevel 19 on each side of the handle. Contact of the rear edge 52 of the hood with bevel 19 limits the exposure of the blade edge 18, as shown in FIG. 2. A hood lock 60 is located on the left side of the handle 11. The hood lock is mounted in a groove 64 in which the lock slides. The hood lock has a notch 62 which engages the rear corner 66 of the hood when the hood lock is in the locked position, as in FIG. 1. In the locked position, the hood is prevented from opening and exposing the blade. FIG. 2 shows the hood lock in the unlocked position which allows the hood to be retracted exposing the blade.

Figure 3:
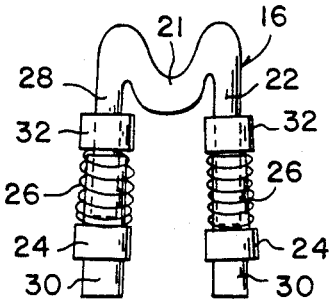
FIG. 3. is a front view of the yoke and spring mounting means of the improved safety knife.

An arm 15 is formed on the upper side of the handle. A notch 20 is formed on the under side of the arm. The purpose of the arm and notch is to retain the yoke 16. FIG. 3 shows the yoke 16 which consists of a neck 21, a left leg 22 and a right leg 28. Spring mounting means bias the yolk against the hood 12. A bushing 32 is attached to each leg of the yoke. A similar bushing 24 is fitted to each of two footing pieces 30. Each footing piece is a piece of hollow tube. A footing piece fits over each leg of the yoke, as shown for the right leg 28 and footing piece 30 in FIG. 4. The extension of right leg 28 into footing piece 30 is indicated by dotted lines. A spring 26 is compressed between the yoke leg bushings 32 and the footing piece bushings 24. The spring biases the footing pieces away from the yoke neck. The relationship between yoke legs, footing pieces, and springs is shown in FIG. 4. In this Fig. the left leg spring is in place, and the right leg spring has been removed. When the hood moves from the closed to the open position, the springs are compressed and the yoke legs move into the footing pieces in a piston action. Arrow 40 indicates the direction of the piston action movement of the footing pieces with respect to the yoke legs.

A footing rest 14 is attached to each side of the hood at the open side of the hood. Each footing rest has a cylindrical socket 34 in the upper side which receives a footing piece. The lower side of the footing rest is flush with the lower side of the hood. The footing rests also function to hold the knife in an upright position with the arm uppermost when the knife is set down when not in use. In addition, the footing rests function to stabilize the knife during cutting, ensuring that the cut is at a right-angle to the surface of the material being cut.

The hood is normally biased by the yoke and spring mounting means in the closed position where the hood protects the razor blade from damage and prevents accidental cuts from the blade. The hood lock is used to prevent accidental opening of the hood which might otherwise occur when the knife is placed in or removed from a pocket. The hood lock is placed on the left side of the knife to facilitate movement of the lock by the operator's thumb when the knife is held in the right hand.

FIG. 1 shows the lock 60 in the closed position. The lock is retained in the groove 64. A notch 62 in one end of the lock retains the upper corner 66 of the hood and prevents pivoting of the hood and exposure of the blade.

FIG. 2 shows the lock 60 in the open position. The lock has been moved to the lower end of the groove 64. In this position, the hood is allowed to swivel freely thereby exposing the blade for use.

Figure 5:
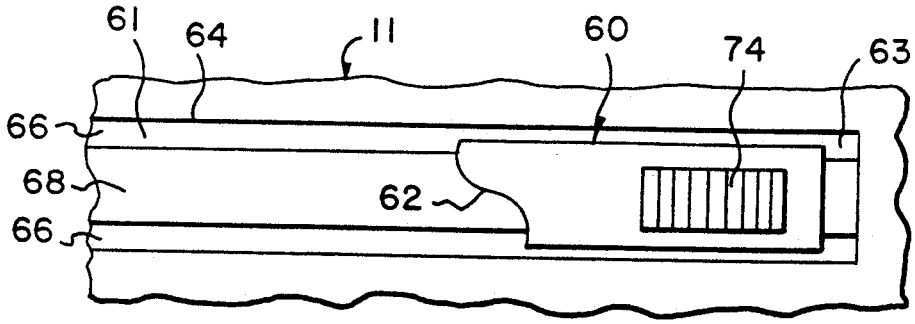
FIG. 5 is a plane view of the handle showing the groove and lock.

FIG. 5 shows details of the lock 60 and groove 64. Slots 66 run along each border of the groove. A groove surface 68 lower than the surface of the handle is formed between the slots. The groove 64 is divided into the lock portion 61 which is the end of the groove nearest the upper side of the handle and the unlock portion 63 which is the end of the groove nearest the lower side of the handle. The lock 60 fits into the groove. A thumb rest 74 protrudes from the top of the lock. The thumb rest has a non-slip surface, such as a serrated surface.

Figure 6:
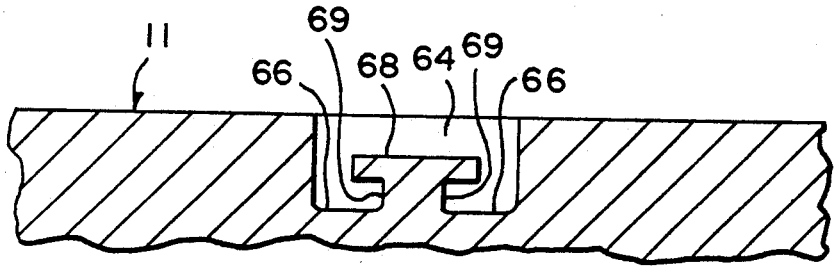
FIG. 6 is a partial cross-section of the handle showing the groove.

FIG. 6 is a cross sectional view of groove 64 which is cut below the surface of the handle 11. FIG. 6 is taken through the unlock portion 63 of the groove. Slots 66 are cut along each side of the groove and extend below the groove surface 68. The groove surface 68 is lower than the surface of the handle. An undercut 69 extends along each side of the groove surface side of the slots.

Figure 7:
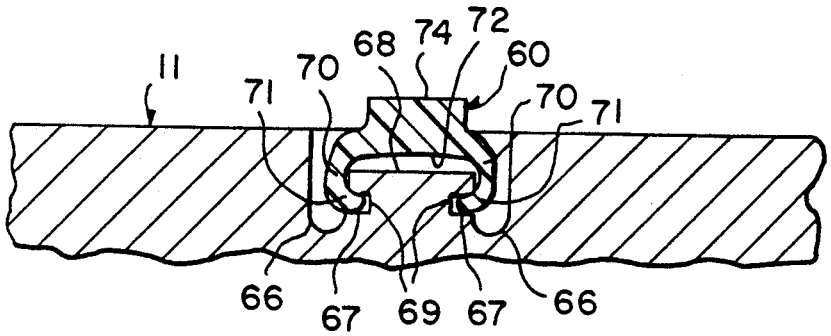
FIG. 7 is a partial cross-section of the handle showing the groove and the lock in a non-sliding position.

FIG. 7 is a cross-sectional view of groove 64 and lock 60. FIG. 7 is taken through the lock portion 61 of the groove. The lock is in the non-sliding position and is fixed in position in the groove. Ears 70 extend along the sides of the lock. Cleats 71 are formed on the ends of the ears. In the lock portion 61 of the groove shoulders 67 are formed on the inner sides of the slots 66. The undercut 69 and shoulders 67 form notches extending along the lock portion 61 of the groove. The ears and cleats of the lock and are biased toward and fit into the notches and contact the notch walls, thereby fixing the lock in the non-sliding position. The bottom side of the lock 72 is concave and does not contact the groove surface 68 when the lock is in the non-sliding position.

Figure 8:
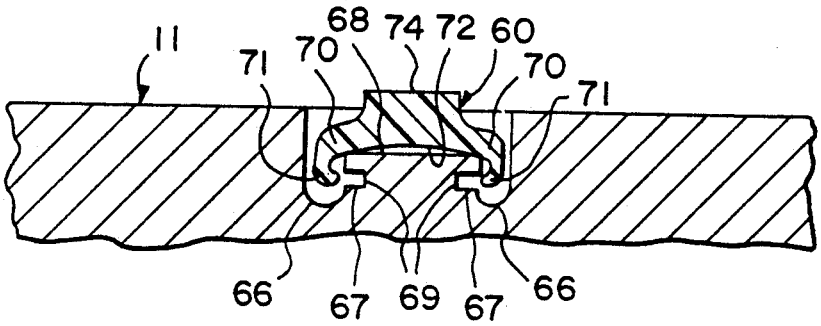
FIG. 8 is a partial cross-section of the handle showing the groove and the lock in a sliding position.

FIG. 8 is a cross-sectional view of groove 64 and lock 60. FIG. 8 is taken through the lock portion 61 of the groove. The lock is in the sliding position when it is freely movable in the groove. This is accomplished by pressure on the thumb rest 74, thereby depressing the bottom side of the lock 74 and swinging the ears 70 and cleats 71 away from the walls of the notches. The lock is now free to slide in the groove. Release of the thumb rest allows the bottom side of the lock to reassume a concave shape and allows the ears and cleats to grip the walls of the notches. The lock is in the non-sliding position when there is no pressure on the thumb rest.

When it is desired to use the utility razor safety knife, the hood lock is slid into the open position, the knife is grasped by the handle and the open side of the hood presssed against the material to be cut. Pressure on the handle causes retraction of the spring mounting means and a pivoting motion of the hood about the set screw. This exposes the razor knife edge and allows cutting to occur. As cutting proceeds, the footing rests 14 contact the surface of the material being cut and serve to maintain the knife razor blade perpendicular to the surface being cut. After the cut is completed and pressure on the knife is released, the spring mounting means cause the hood to move to the closed position where the blade is protected against accidental damage and the user is protected against accidental injury by the blade. The hood is transparent, allowing the user to observe the cut as it is being made, ensuring more accurate cutting.

The yoke exerts its pressure on the hood at two points, one on each side of the hood. This stabilizes the hood by preventing the hood from becoming skewed to one side or the other of the knife while in use.

The handle is made of any suitable strong and hard material, such as steel, aluminum or hard plastic. The hood is made of a hard transparent material, such as polystyrene or polycarbonate. The lock is made of a resilient polymeric material. Conventional razor blades made for utility razor safety knives are used.

A variety of blades ranging from thin to thick may be accommodated by this knife for use in cutting light to heavy materials. The pressure exerted on the hood by the yoke and spring mounting means may be varied by changing the gauge or size of the springs. To disassemble the knife, one grips the handle with two hands and uses one's thumbs to press the yoke in a downward motion so the neck moves away from the notch in the arm. The yoke is then moved forward until the neck is free of the arm. The yoke is then carefully released until the footing pieces are removed from the sockets of the footing rests. Next, set screw 42 is removed and the hood removed. Finally, set screw 44 is removed and the two sides of the handle separated. The razor blade is freed from retention by the two sides of the handle and may be replaced.

The knife is assembled by reversing the above steps.

Springs of varying gauges or strengths may be substituted as desired to fit the knife to the job at hand. Relatively light or weak springs may be appropriate to precision cutting at a worktable. Relatively heavy or strong springs may be appropriate to rough cutting of roofing material under cutting conditions which require heavy cutting pressure on the work and also involve constant movement of the person doing the cutting.

It will be apparent to those skilled in the art that the examples and embodiments described herein are by way of illustration and not of limitation, and that other examples may be utilized without departing from the spirit and scope of the present invention, as set forth in the appended claims.

I claim:

1. An improved utility razor safety knife of the type having a handle, a blade attached to the handle, and a blade guard hood pivotally attached to the handle and capable of pivoting between a closed position and an open position, wherein the improvement comprises:

a yoke having two legs and a neck for biasing the hood in the closed position and for stabilizing the hood, an arm on the handle having means for retaining the neck of the yoke and for attaching the yoke to the handle, spring mounting means on each yoke leg for urging the hood in the closed position while allowing the hood to move to the open position during use of the utility razor safety knife comprising a bushing attached to a yoke leg, a footing piece comprising a tube into which a yoke leg is inserted and having a bushing attached to the footing piece, and a spring surrounding the yoke leg and footing piece between the bushing attached to a yoke leg and the bushing attached to the footing piece, said spring bearing on the bushings so as to exert a force biasing the footing piece away from the yoke neck, and a hood having a front end and rear edge, pivotally attached to the handle near the rear edge of the hood, whereby the hood pivots with movement of the front end of the hood toward the arm, the hood having footing rest means for receiving the yoke legs and spring mounting means, and for stabilizing the utility razor safety knife.

2. The improvement of claim 1, wherein the footing rest means comprise sockets.

3. The improvement of claim 1, further comprising a lock which prevents the opening of the hood.

4. The improvement of claim 3 wherein the lock is mounted on the handle, slides in a groove, and engages the hood when the hood is in the closed position.

* * * * *